United States Patent [19]

Jacoby

[11] 3,947,914

[45] Apr. 6, 1976

54] COLLAPSIBLE BRUSH

76] Inventor: Albert Jacoby, 4 Plymouth Place, White Plains, N.Y. 10605

22] Filed: Feb. 15, 1974

21] Appl. No.: 443,085

52] U.S. Cl. ..... 15/203
51] Int. Cl.[2] ..... A46B 9/10
58] Field of Search ..... 15/203; 132/85, 121

56] References Cited

UNITED STATES PATENTS

| | | | |
|---|---|---|---|
| ,231,093 | 6/1917 | Sundeen | 15/203 |
| ,604,649 | 7/1952 | Stephenson et al. | 15/203 X |
| ,981,965 | 5/1961 | Kaye et al. | 15/203 |
| ,086,236 | 4/1963 | Anonsen | 15/203 |

FOREIGN PATENTS OR APPLICATIONS

| | | | |
|---|---|---|---|
| 418,966 | 11/1934 | United Kingdom | 15/203 |

*Primary Examiner*—Peter Feldman
*Attorney, Agent, or Firm*—Howard C. Miskin

[57] ABSTRACT

A collapsible brush includes an open topped housing provided with a removable lid and a plurality of longitudinally spaced transverse bars which are located in the housing and have flat top faces, angularly related front and rear faces gear sector under faces. Stub shafts project from the upper end faces of the bars and are journalled in aligned recesses in the housing side walls and have flat top faces coplanar with the bar top faces. Bristle tufts are anchored in the bar top faces. A longitudinally slidable rack is sandwiched between the housing base and the gear sectors and is connected to a longitudinally movable brush handle either directly or by a lost motion coupling so that extension of the handle extends the bristles and retraction of the handles swings the bristles into collapsed overlapping positions.

7 Claims, 11 Drawing Figures

COLLAPSIBLE BRUSH

BACKGROUND OF THE INVENTION

The present invention relates generally to improvements in brushes and it relates more particularly to an improved collapsible brush.

The use of hair brushes among both men and women is widespread and it is highly desirable to carry the hair brush about upon the person. However, the conventional hair brush possesses numerous drawbacks and does not lend itself to personal portability. If it is small enough to be conveniently carried, it is not large enough to suitably function as a hair brush and, on the other hand, if it is adequately large for proper use, it is too large to carry about in a pocket or in a pocketbook or handbag and if so carried, it is unsanitary and messy and interferes with the accessibility of the other articles contained in the handbag. Numerous types and constructions of collapsible hair brushes have heretofore been proposed but these likewise possess many disadvantages. They are complicated and unreliable devices, having spaced bristles, which are difficult to operate and use, are bulky, unattractive and otherwise leave much to be desired.

SUMMARY OF THE INVENTION

It is a principal object of the present invention to provide an improved brush.

Another object of the present invention is to provide an improved hair brush which has closely spaced bristles and is conveniently carried on the person.

Still another object of the present invention is to provide an improved hair brush which is simply and easily collapsed to a compact housed condition and is readily and easily extended to a fully extended operative condition.

A further object of the present invention is to provide an improved brush of the above nature characterized by its reliability, ruggedness, simplicity, attractive appearance, great compactness when collapsed and convenient size when extended, ease and convenience of use and operation and great versatility and adaptability.

The above and other objects of the present invention will become apparent from a reading of the following description taken in conjunction with the accompanying drawings which illustrate preferred embodiments of the present invention.

In a sense the present invention contemplates the provision of an improved collapsible brush comprising a body member including a pair of spaced side walls having a plurality of longitudinally spaced pairs of transversely aligned journal recesses in their confronting faces, transverse bars of noncircular cross section provided at the upper parts of their end faces with stub shafts journalled in respective apertures and having gear sector underfaces, brush bristles anchored in the top face of each bar, a longitudinally slidable rack underlying and engaging the gear sectors and a handle extending from the rack and longitudinally movable therewith; advantageously the top front and rear faces of the bars are flat and when in bristle extended condition the top faces are horizontal, the front faces vertical and the rear faces forwardly upwardly inclined. The body member is in the shape of an open topped flat receptacle provided with a separable closure plate and the rack is sandwiched between the sector gears and the receptacle base. In one form the handle is secured to the rack and extends medially through an opening in the receptacle end wall and in another form the handle terminates at its inner end in a head engaging a medial longitudinal slot in the rack to provide a longitudinal lost motion coupling between the rack and handle and permitting the housing of the handle in the receptacle. An abutment is formed on the leading section of the rack and engages the front face of the leading bar when the bristles are in their fully extended positions and the bristles overlap each other when in their collapsed condition.

The improved collapsible brush is reliable, rugged, attractive, highly compact when collapsed and of highly suitable size when extended and is easy and convenient to use and operate and is of great versatility and adaptability.

DESCRIPTION OF THE PREFERRED EMBODIMENTS

Figure 1:
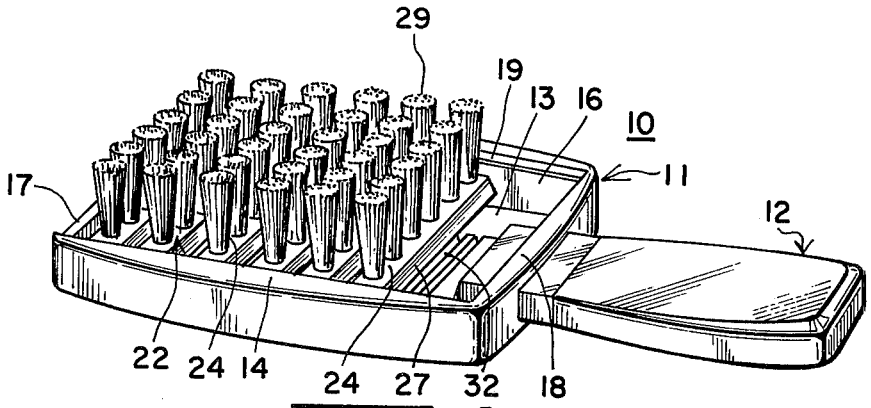
FIG. 1 is a top perspective view of a collapsible brush embodying the present invention and shown in an extended condition.

Referring now to the drawings, particularly FIGS. 1–6 thereof which illustrate a preferred embodiment of the present invention, the reference numeral 10 generally designates the improved collapsible brush which comprises an open topped shallow receptacle shaped body member 11 and a handle defining actuating member 12. The body member includes an approximately rectangular base wall 13 having a flat inside face, similarly shaped side walls 14 having vertical confronting parallel inside faces 16 and front and rear transverse end walls 17 and 18 respectively, the upper edges of walls 14 and 18 being coplanar and the upper edge of wall 17 being below the level of the upper edges of walls 14 and 18.

Formed in the upper borders of the inside faces 16 of walls 14 at about the level of the top edge of wall 17 are parallel grooves 19 of triangular cross section and a rectangular closure lid 20 separably registers with the receptacle opening and slidably engages the grooves 19. Also formed in the wall faces 16 are regularly longitudinally spaced pairs of transversely aligned bearing defining bars or recesses. Medially positioned on the upper face of base wall 13 is a longitudinally extending guide defining rib 21.

Rockably supported between receptacle side walls 14 is a group of periodically longitudinally spaced parallel transverse bristle enchoring bars 22. Each of the bars 22 terminate at opposite ends in axially aligned stub shafts 23 journalled in corresponding bearing recesses in side wall inside faces 16. The group of bars 22 is fowardly offset relative the medial transverse axis of receptacle 11, so as to be closer to end wall 17 than end wall 18. The stub shafts 23 are of reduced cross section and are located proximate the upper faces of bars 22.

Each of the bars 22 includes a flat top face 24, a flat front face 26 depending from and perpendicular to face 24, a rear flat face 27 forming an obtuse angle with face 24 and an arcuate underface coaxial with corresponding stub shafts 23 and extending between the bottom edges of faces 26 and 27. Formed in the bar underface are longitudinally extending gear teeth to form an elongated gear sector 28 coaxial with stub shafts 23 and extending peripherally for somewhat less than 90°. Longitudinally spaced wells are formed in the bar top faces 24 and tufts of bristles 29 which are upwardly directed from the bar faces 24 are anchored therein in a known manner.

A longitudinally extending rack 32 having a flat underface and a toothed upper face slidably rests and is medially located on the inside face of base wall 13 and has a medial longitudinal slot 70 formed thereon slidably engaging guide rib 21. The rack 32 is sandwiched between base wall 13 and gear sectors 28 and meshes with the gear sectors so that longitudinal movement of rack 32 affects the angular movement of bars 22.

An abutment defining lip 33 is directed upwardly along the transverse leading edge of rack 32 and engages the front face 26 of the leading bar 22 when the bars 22 are rocked to the fully extended upright position of bristles 29. An elongated handle member 34 is integrally formed with rack 32 and projects medially rearwardly therefrom through a mating opening formed in rear wall 18. A boss or detent 36 is formed on a side face of handle member 34 within receptacle 11 and releasably engages a recess formed in a resilient arm 37 located on base wall 13 to releasably lock the handle 34 and rack 32 in their retracted positions in which the bristles 29 are extended.

Figure 2:
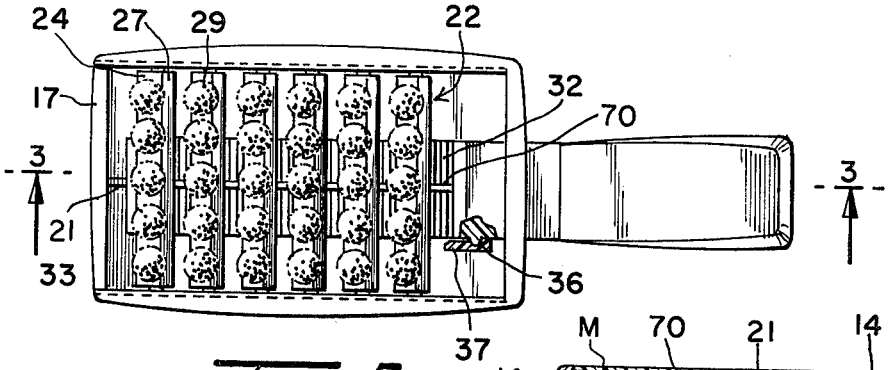
FIG. 2 is a top plan view thereof.
Figure 6:
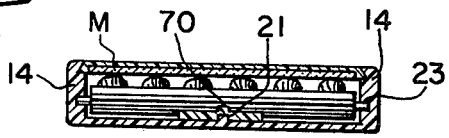
FIG. 6 is a sectional view taken along line 6—6 in FIG. 5.
Figure 3:
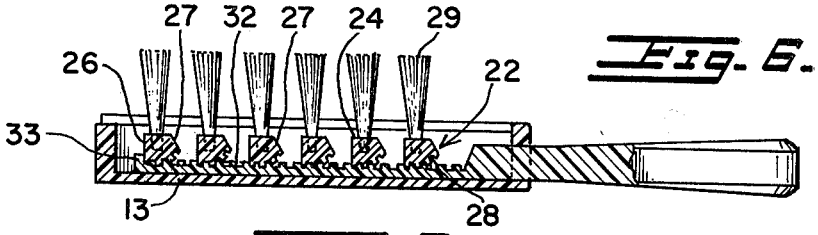
FIG. 3 is a sectional view taken along line 3—3 in FIG. 2.
Figure 4:
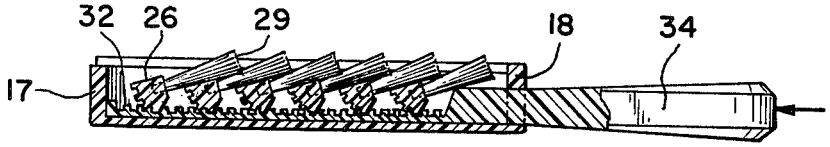
FIG. 4 is a view similar to FIG. 3 with the brush shown in collapsed condition.
Figure 5:
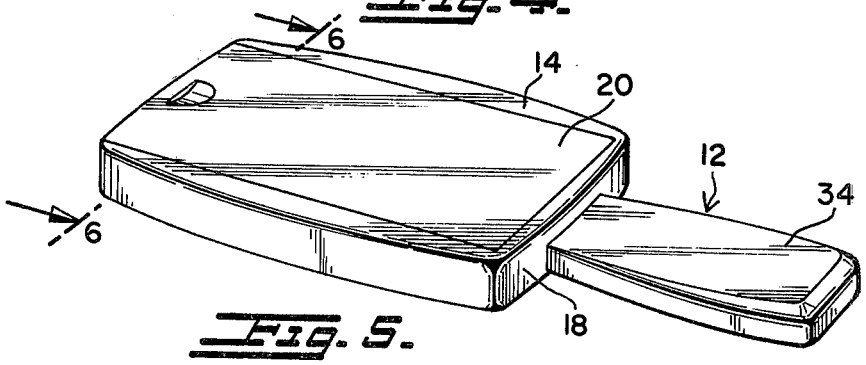
FIG. 5 is a top perspective view of the brush in a collapsed closed condition.
Figure 7:
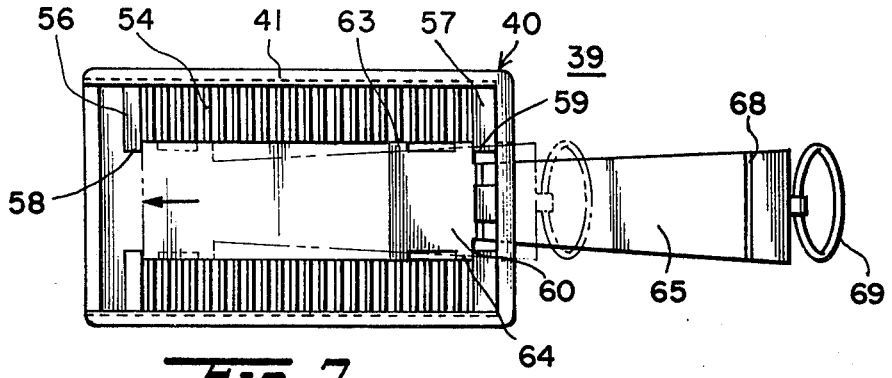
FIG. 7 is a top plan view of another embodiment of the present invention shown with parts thereof omitted.
Figure 8:
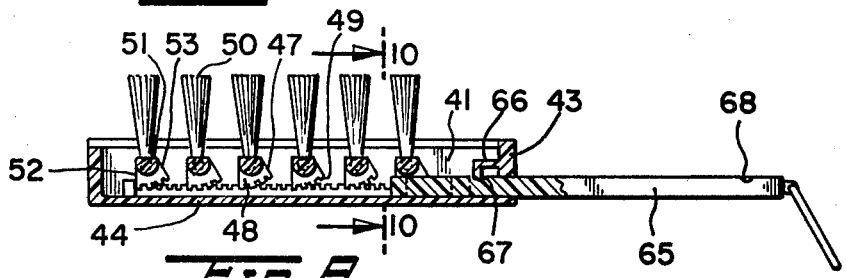
FIG. 8 is a front elevational view thereof partially in medial section.
Figure 9:
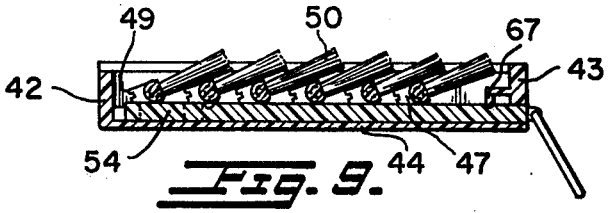
FIG. 9 is a view similar to FIG. 8 shown in collapsed condition.
Figure 10:
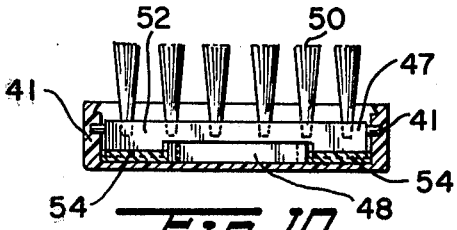
FIG. 10 is a sectional view taken along line 10—10 in FIG. 8.
Figure 11:
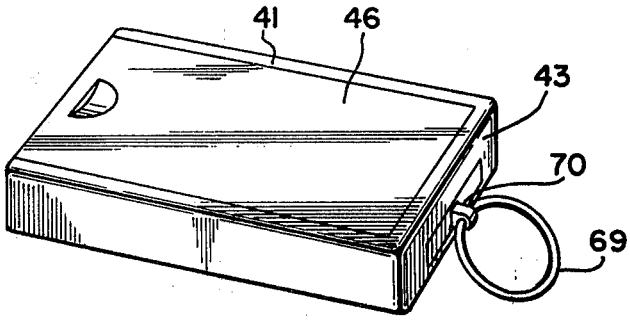
FIG. 11 is a top perspective view of the brush in a closed collapsed condition.

In the collapsed condition of the brush 10 the handle 12 is in its forward position and the bars 22 are rocked clockwise to bring the bristles 29 in an overlapping condition, as shown in FIG. 4, and the receptacle 11 is closed by the lid 20 as shown in FIG. 5. To transfer the brush to its operative condition, the cover 20 is removed and the handle 34 is retracted until abutment lip 33 engages the forwardmost bar face 26 and detent 36 engages the recess in arm 37. The retraction of handle member 34 retracts the rack 32 to rock bars 22 counterclockwise and erect the bristles 29 as shown in FIGS. 1–3.

In FIGS. 7–11 of the drawings there is illustrated another embodiment of the present invention which differs from that first described primarily in that a lost motion coupling is provided between the rack and handle to permit the housing of the handle in the receptacle in the collapsed condition of the brush.

Specifically, the improved brush 39 comprises a receptacle 40 similar in construction to the earlier described receptacle 11 and includes side walls 41 having longitudinal grooves and bearing recesses, front end wall 42, apertured rear end wall 43, base wall 44 and slide lid 46. Rockably supported between the side walls

41 are longitudinally spaced bars 47 differing in construction from the bars 22 in that a medial groove 48 is formed in the underface of each bar 47. Each bar 47 includes a pair of laterally spaced gear sectors 49 in its underface spaced by the groove 48 and coaxial with the stub shafts extending from the bar and journalled in the side wall bearing recesses. The base of the groove 48 is cylindrical and coaxial with the stub shafts. The bars 47 include flat top faces 51 in which are anchored upstanding bristle tufts 50, front faces 52 perpendicular to top faces 51 and flat rear faces 53 at an obtuse angle to top faces 51.

A pair of transversely spaced longitudinally movable racks 54 slidably rest on base wall 44 adjacent to side walls 41 and mesh with the gear sectors 49 of the bars 47. Projecting upwardly from the front and rear ends of each rack 54 are front and rear abutment defining lips 56 and 57 respectively, the lips being provided with inwardly directed front and rear ears 58 and 59.

Longitudinally slidably disposed between the confronting side edges of racks 54 is a lost motion coupling head 60 which rests on the base wall 44 and registers with the grooves 48, its top face being at about the level of the bases of grooves 48. Front and rear ears 63 and 64 project laterally from the front and rear side faces of head 60 and are longitudinally aligned with rack ears 58 and 59. Thus, when the head 60 is advanced forwardly from its fully retracted position, the head ears 64 disengage the rack ears 59 and the head travels along the length of the receptacle until the head ears 63 bear on rack ears 58 to advance the racks 54 forwardly and rotate the bars 47 clockwise, as viewed in FIGS. 8 and 7, to collapse the bristles to an overlapping collapsed condition. By retracting the head 60, it moves rearwardly to bear on rack ears 59 and retract racks 54 which rock the bars 47 counterclockwise and erect the bristles 50.

An elongated handle 65 is integrally formed with and extends rearwardly medially from the head 60 through an opening in rear walls 43. A resilient finger 66 projects medially inwardly from rear wall 43 and terminates in a depending detent 67 which releasably engages a front or rear recess 68 in the top face of handle 68 when it is in its retracted or housed position respectively. When the handle 65 is withdrawn, it effects the erection of the bristles during the end of its stroke, as described above, and is releasably locked in its extended position by the detent 67 and when the handle 65 is advanced to its receptacle housed position it collapses the bristles 50 at the end of its advance stroke and is releasably locked in its housed position by the detent 67. To facilitate the withdrawal of the handle 65 a ring 69 is attached to the outer end of the handle 65 by means of an apertured lug 70 formed on the outer end face of handle 65. As in the first embodiment, when the bristles 50 are fully erected the lips 56 abut the front faces 52 of the forwardmost bar 47.

The present invention provides a short arc or rotation to rotate the bristles from a "down" or closed position to an "up" or usable position. The axles are closer to the flat surface from which the bristles extend than to the gear sectors providing a mechanical advantage. The flat faces 27 and 53 of each of bars 22 and 47 respectively allows the bars 22 and 47 to be set closer to adjoining bars to provide a denser brush and a thinner unit, which is important to its portability and packing in pocket or pocketbook.

While here have been described and illustrated preferred embodiments of the present invention, it is apparent that numerous alterations, omissions and additions may be made without departing from the spirit thereof.

What is claimed is:

1. A collapsible brush comprising a body member including a pair of upwardly directed transversely spaced longitudinally extending parallel walls having a plurality of longitudinally spaced pairs of transversely aligned recesses formed in the confronting faces thereof, a plurality of longitudinally spaced transversely extending bars of non-circular transverse cross section having shafts at opposite ends thereof journalled in corresponding pairs of said recesses, each of said bars having a gear sector defining toothed arcuate underface, brush bristles secured to and projecting upwardly from each of said bars, a longitudinally slidable longitudinally extending rack underlying and engaging said gear sectors, a longitudinally extending handle member longitudinally movable along a path between said parallel walls between a retracted and an extended position, means including a lost motion coupling between said rack and said handle for oppositely moving said rack with the movement of said handle proximate its extended and retracted positions to rock said bars and swing said bristles between upwardly directed extended positions and overlapping collapsed positions respectively, means to maintain said bristles in locked upwardly direct position, said lost motion coupling including abutment means located at opposite ends of said rack, and said handle member having a head section moveable along said rack and alternatively engaging said abutments with the longitudinal movement of said handle member toward extended and retracted positions.

2. The brush of claim 1 wherein said body member includes a base section extending between said side walls, said rack being embraced between said gear sector and the confronting face of said base section and being slidable along said face.

3. The brush of claim 2 wherein the top faces of said bars are relatively flat and said shafts are located proximate said top faces.

4. The brush of claim 3 wherein each of said gear sectors extend for less than 90°.

5. The brush of claim 4 wherein said bars have flat distal faces substantially perpendicular to the top faces thereof and flat proximal faces forming obtuse angles with said top faces.

6. The brush of claim 2 wherein said bristles, when in their collapsed condition, are below the level of the top edges of said side walls and including a cover member separably closing the space delineated by said top edges.

7. The brush of claim 1 including a laterally spaced pair of said racks, each of said racks including abutments located at opposite ends, said handle members terminating at its inner end in a head section slidably between and along said racks and alternatively engaging said abutments with the longitudinal movement of said handle toward extended and retracted positions, said abutments and said head defining said lost motion coupling.

* * * * *